US007424922B2

(12) United States Patent
Hall et al.

(10) Patent No.: US 7,424,922 B2
(45) Date of Patent: Sep. 16, 2008

(54) ROTARY VALVE FOR A JACK HAMMER

(76) Inventors: David R. Hall, 2185 S. Larsen Pkwy., Provo, UT (US) 84606; David Wahlquist, 2185 S. Larsen Pkwy., Spanish Fork, UT (US) 84606

( * ) Notice: Subject to any disclaimer, the term of this patent is extended or adjusted under 35 U.S.C. 154(b) by 46 days.

(21) Appl. No.: 11/686,638

(22) Filed: Mar. 15, 2007

(65) Prior Publication Data

US 2007/0221412 A1 Sep. 27, 2007

Related U.S. Application Data

(63) Continuation-in-part of application No. 11/680,997, filed on Mar. 1, 2007, which is a continuation-in-part of application No. 11/673,872, filed on Feb. 12, 2007, which is a continuation-in-part of application No. 11/611,310, filed on Dec. 15, 2006, and a continuation-in-part of application No. 11/278,935, filed on Apr. 6, 2006, which is a continuation-in-part of application No. 11/277,394, filed on Mar. 24, 2006, which is a continuation-in-part of application No. 11/277,380, filed on Mar. 24, 2006, now Pat. No. 7,337,856, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.
*E21B 10/26* (2006.01)
*E21B 34/06* (2006.01)

(52) U.S. Cl. ..... 175/317; 175/107; 175/324; 175/381; 175/385

(58) Field of Classification Search ..... 175/324, 175/321, 317, 415, 385, 381, 107, 393
See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kuhne |
| 946,060 | A | 1/1910 | Looker |
| 1,116,154 | A | 11/1914 | Stowers |

(Continued)

*Primary Examiner*—Hoang Dang
(74) *Attorney, Agent, or Firm*—Tyson J. Wilde

(57) ABSTRACT

In one aspect of the present invention a tool string comprises a jack element substantially coaxial with an axis of rotation. The jack element is housed within a bore of the tool string and has a distal end extending beyond a working face of the tool string. A rotary valve is disposed within the bore of the tool string. The rotary valve has a first disc attached to a driving mechanism and a second disc axially aligned with and contacting the first disc along a flat surface. As the discs rotate relative to one another at least one port formed in the first disc aligns with another port in the second disc. Fluid passed through the ports is adapted to displace an element in mechanical communication with the jack element.

20 Claims, 9 Drawing Sheets

U.S. PATENT DOCUMENTS 1,183,630 A 5/1916 Bryson
1,189,560 A 7/1916 Gondos
1,360,908 A 11/1920 Everson
1,387,733 A 8/1921 Midgett
1,460,671 A 7/1923 Hebsacker
1,544,757 A 7/1925 Hufford
1,821,474 A 9/1931 Mercer
1,879,177 A 9/1932 Gault
2,054,255 A 9/1936 Howard
2,064,255 A 12/1936 Garfield
2,169,223 A 8/1939 Christian
2,218,130 A 10/1940 Court
2,320,136 A 5/1943 Kammerer
2,371,248 A * 3/1945 McNamara ..... 173/64
2,466,991 A 4/1949 Kammerer
2,540,464 A 2/1951 Stokes
2,545,036 A 3/1951 Kammerer
2,755,071 A 7/1956 Kammerer
2,776,819 A 1/1957 Brown
2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,135,341 A 6/1964 Ritter
3,216,514 A * 11/1965 Nelson ..... 175/238
3,294,186 A 12/1966 Buell
3,301,339 A 1/1967 Pennebaker, Jr.
3,379,264 A 4/1968 Cox
3,429,390 A 2/1969 Bennett
3,493,165 A 2/1970 Schonfield
3,583,504 A 6/1971 Aalund
3,764,493 A 10/1973 Rosar
3,815,692 A * 6/1974 Varley ..... 175/65
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott et al.
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine et al.
6,340,064 B2 1/2002 Fielder .
6,364,034 B1 4/2002 Schoeffler
6,394,200 B1 5/2002 Watson
6,439,326 B1 8/2002 Huang et al.
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswami
9,629,076 4/2005 Fanuel
6,953,096 B2 10/2005 Gledhill et al.
2003/0213621 A1 11/2003 Britten
2004/0238221 A1 12/2004 Runia
2004/0256155 A1 12/2004 Kriesels

* cited by examiner

ROTARY VALVE FOR A JACK HAMMER

CROSS REFERENCE TO RELATED APPLICATIONS

This patent application is a continuation-in-part of U.S. patent application Ser. No. 11/680,997 filed on Mar. 1, 2007 and entitled Bi-center Drill Bit. U.S. patent application Ser. No. 11/680,997 is a continuation-in-part of U.S. patent application Ser. No. 11/673,872 filed on Feb. 12, 2007 and entitled Jack Element in Communication with an Electric Motor and/or generator. U.S. patent application Ser. No. 11/673,872 is a continuation-in-part of U.S. patent application Ser. No. 11/611,310 filed on Dec. 15, 2006 and which is entitled System for Steering a Drill String. This patent application is also a continuation-in-part of U.S. patent application Ser. No. 11/278,935 filed on Apr. 6, 2006 and which is entitled Drill Bit Assembly with a Probe. U.S. patent application Ser. No. 11/278,935 is a continuation-in-part of U.S. patent application Ser. No. 11/277,394 which filed on Mar. 24, 2006 and entitled Drill Bit Assembly with a Logging Device. U.S. patent application Ser. No. 11/277,394 is a continuation-in-part of U.S. patent application Ser. No. 11/277,380 also filed on Mar. 24, 2006 and entitled A Drill Bit Assembly Adapted to Provide Power Downhole, now U.S. Pat. No. 7,337,856. U.S. patent application Ser. No. 11/277,380 is a continuation-in-part of U.S. patent application Ser. No. 11/306,976 which was filed on Jan. 18, 2006 and entitled Drill Bit Assembly for Directional Drilling, now U.S. Pat. No. 7,360,610. U.S. patent application Ser. No. 11/306,976 is a continuation-in-part of Ser. No. 11/306,307 filed on Dec. 22, 2005, entitled Drill Bit Assembly with an Indenting Member, now U.S. Pat. No. 7,225,886. U.S. patent application Ser. No. 11/306,307 is a continuation-in-part of U.S. patent application Ser. No. 11/306,022 filed on Dec. 14, 2005, entitled Hydraulic Drill Bit Assembly, now U.S. Pat. No. 7,198,119. U.S. patent application Ser. No. 11/306,022 is a continuation-in-part of U.S. patent application Ser. No. 11/164,391 filed on Nov. 21, 2005, which is entitled Drill Bit Assembly, now U.S. Pat. No. 7,270,196. All of these applications are herein incorporated by reference in their entirety.

BACKGROUND OF THE INVENTION

This invention relates to the field of percussive tools used in drilling. More specifically, the invention relates to the field of downhole jack hammers which may be actuated by the drilling fluid. Typically, traditional percussion bits are activated through a pneumonic actuator. Through this percussion, the drill string is able to more effectively apply drilling power to the formation, thus aiding penetration into the formation.

The prior art has addressed the operation of a downhole hammer actuated by drilling mud. Such operations have been addressed in the U.S. Pat. No. 7,073,610 to Susman, which is herein incorporated by reference for all that it contains. The '610 patent discloses a downhole tool for generating a longitudinal mechanical load. In one embodiment, a downhole hammer is disclosed which is activated by applying a load on the hammer and supplying pressurizing fluid to the hammer. The hammer includes a shuttle valve and piston that are moveable between first and further position, seal faces of the shuttle valve and piston being released when the valve and the piston are in their respective further positions, to allow fluid flow through the tool. When the seal is releasing, the piston impacts a remainder of the tool to generate mechanical load. The mechanical load is cyclical by repeated movements of the shuttle valve and piston.

U.S. Pat. No. 6,994,175 to Egerstrom, which is herein incorporated by reference for all that it contains, discloses a hydraulic drill string device that can be in the form of a percussive hydraulic in-hole drilling machine that has a piston hammer with an axial through hole into which a tube extends. The tube forms a channel for flushing fluid from a spool valve and the tube wall contains channels with ports cooperating with the piston hammer for controlling the valve.

U.S. Pat. No. 4,819,745 to Walter, which is herein incorporated by reference for all that it contains, discloses a device placed in a drill string to provide a pulsating flow of the pressurized drilling fluid to the jets of the drill bit to enhance chip removal and provide a vibrating action in the drill bit itself thereby to provide a more efficient and effective drilling operation.

BRIEF SUMMARY OF THE INVENTION

In one aspect of the present invention a tool string comprises a jack element substantially coaxial with an axis of rotation. The jack element is housed within a bore of the tool string and has a distal end extending beyond a working face of the tool string. A rotary valve is disposed within the bore of the tool string. The rotary valve has a first disc attached to a driving mechanism and a second disc axially aligned with and contacting the first disc along a flat surface. As the discs rotate relative to one another at least one port formed in the first disc aligns with another port in the second disc. Fluid passed through the ports is adapted to displace an element in mechanical communication with the jack element. In a downhole environment, a the fluid displaces the element, the jack element oscillates, thereby furthering the penetration into a formation.

The driving mechanism controlling the first disc may be a turbine or a motor. The jack element may be adapted to rotate the second disc. However, the second disc may be fixed to a bore wall of the tool string. The jack element and the driving mechanism may rotate opposite each other when in operation. Thus, the first and second discs may rotate opposite each other. The jack element may be stationary with respect to the formation.

At least two fluid ports may be formed in the second disc. During operation, all the drilling fluid may be passed through the fluid ports. However, only a portion of the drilling fluid may pass through the fluid ports. A sensor attached to the tool string may be adapted to receive acoustic reflections produced by the movement of the jack element. The element may be a ring, a rod, a piston, a block, or a flange. In some cases, the element may be rigidly attached to the jack element. Further, the element may be part of the jack element. Thus, the drilling fluid may be in direct communication with the jack element. A flat surface of the element and the flat surface of the disc may comprise materials selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bounded diamond, and/or combinations thereof.

DETAILED DESCRIPTION OF THE INVENTION AND THE PREFERRED EMBODIMENT

Figure 1:
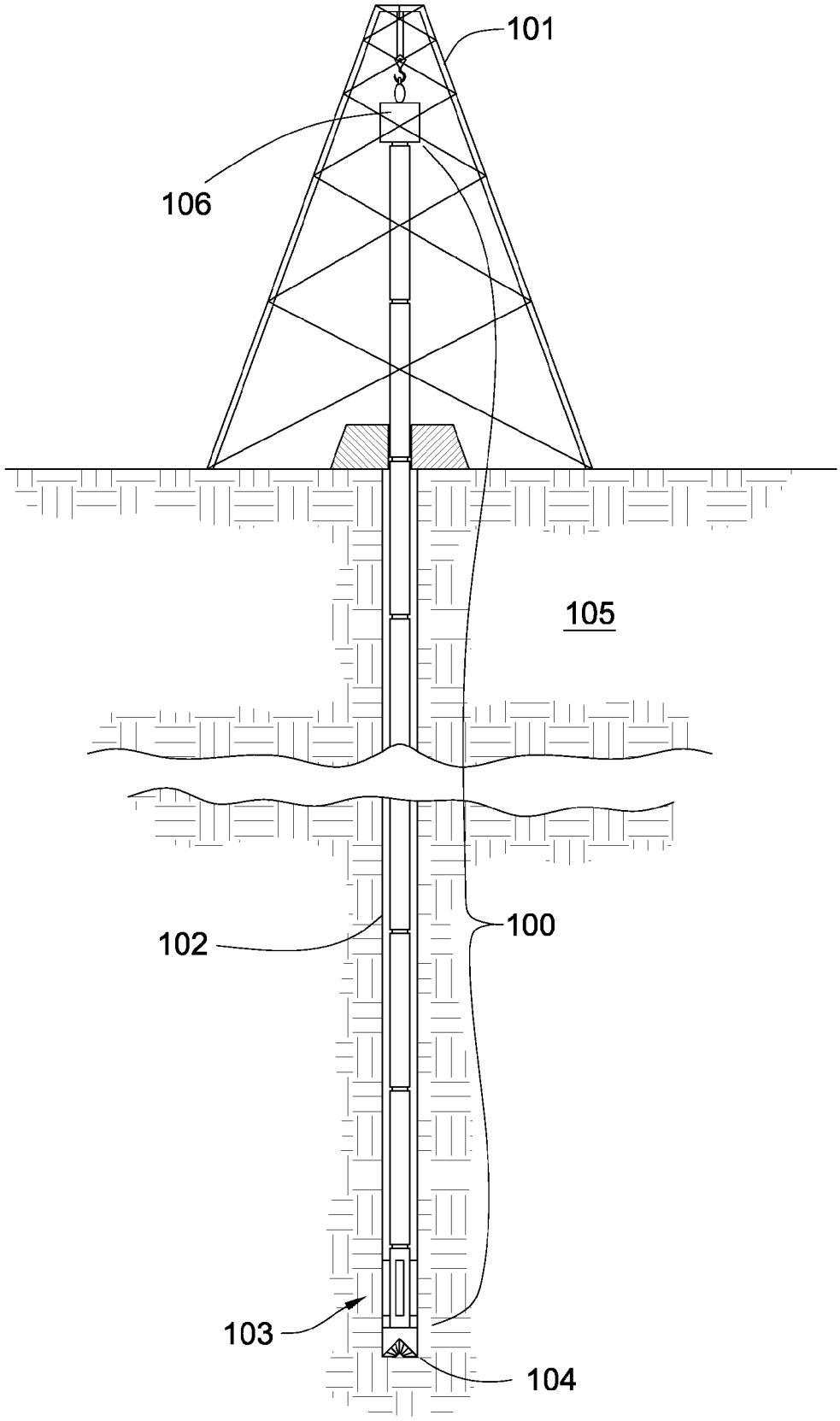
FIG. 1 is a perspective diagram of an embodiment of a tool string suspended in a borehole.

FIG. 1 is a perspective diagram of an embodiment of a tool string 100 suspended by a derrick 101 in a bore hole 102. A bottom-hole assembly 103 is located at the bottom of the bore hole 102 and comprises a drill bit 104. As the drill bit 104 rotates downhole the tool string 100 advances farther into the earth. The drill string 100 may penetrate soft or hard subterranean formations 105. The bottom-hole assembly 103 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom hole assembly 103. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, wire pipe, and/or short hop. In some embodiments, no telemetry system is incorporated into the drill string.

Figure 2:
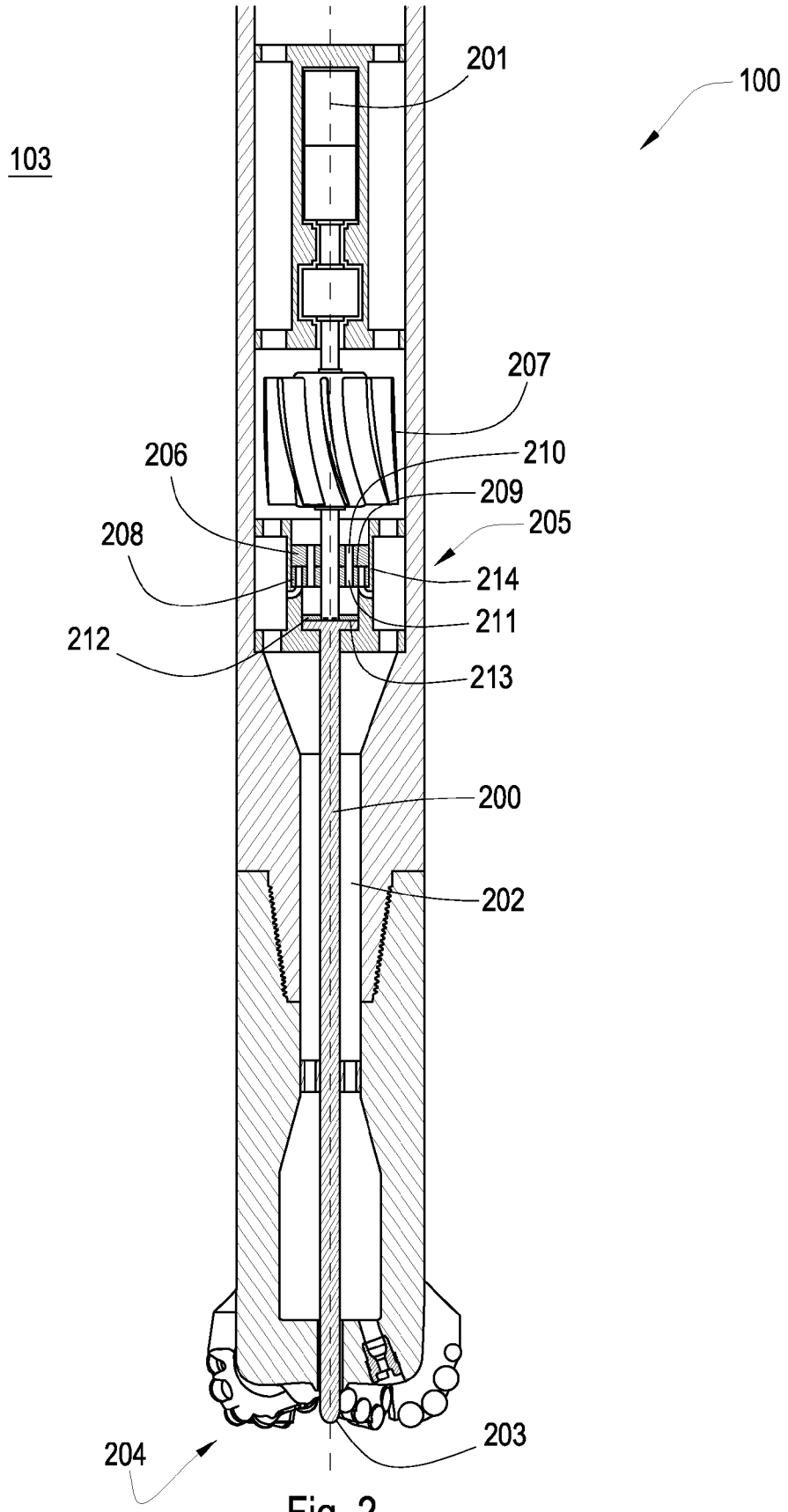
FIG. 2 is a cross-sectional diagram of an embodiment of a bottom-hole assembly.

FIG. 2 is a cross-sectional diagram of an embodiment of a bottom-hole assembly 103. A downhole tool string 100 has a jack element 200 that may be substantially coaxial with an axis of rotation 201 housed within a bore 202 of the tool string 100. The jack element 200 may have a distal end 203 extending beyond a working face 204 of the tool string 100. In some embodiments, the distal end of the jack element is biased to affect steering. A rotary valve 205 may be disposed within the bore 202 and may have a first disc 206 attached to a driving mechanism 207. In the preferred embodiment, the driving mechanism 207 is a turbine. However, in other embodiments the driving mechanism may be a hydraulic or electric motor. A second disc 208 may be axially aligned with and contact the first disc 206 along a flat surface 209. As the discs 206, 208 rotate relative to one another during operation, at least one port 210 formed in the first disc 206 aligns with another port 211 in the second disc 208. The fluid that passes through the aligned ports 210, 211 may be adapted to displace an element 212 in mechanical communication with the jack element 200. As the discs continue to rotate, more fluid may be ported into the hydraulic chambers 350 containing the element and the ported fluid may displace the element in opposing directions. Preferably, as the element is displaced in opposing directions it will vibrate the jack element. In the preferred embodiment, the element 212 is a ring. However, in other embodiments the element may be a rod, a piston, a block, or a flange. In some embodiments, the element 212 may be rigidly attached to the jack element 200 or may be part of the jack element 200. The element 212 may have a flat surface 213 comprising a material selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bounded diamond, and/or combinations thereof.

In some embodiments, the jack element 200 may be adapted to rotate the second disc 208. In other embodiments, the second disc 208 may be fixed to a wall 214 of the bore 202. The jack element 200 and the driving mechanism 207 may rotate opposite each other such that the first and second discs 206, 208 rotate opposite each other. In some embodiments, the jack element 200 may be stationary with respect to a formation during a drilling operation.

At least two fluid ports 211 may be formed in the second disc 208. During a drilling operation, all the drilling fluid may be passed through the fluid ports 210, 211 or only a portion of the drilling fluid may be passed through the fluid ports. In hard formations, it may be beneficial to allow all the drilling fluid to pass through the ports 210, 211 such that the vibrations of the jack element 200 are maximized to more effectively penetrate the formation. However, in soft formations, it may not be necessary to vibrate the jack element 200. Thus, not all the drilling fluid may pass through the fluid ports 210, 211. Furthermore, in some formations all the drilling fluid may bypass the ports 210, 211 such that the drilling fluid does not vibrate or displace the jack element 200.

Figure 3:
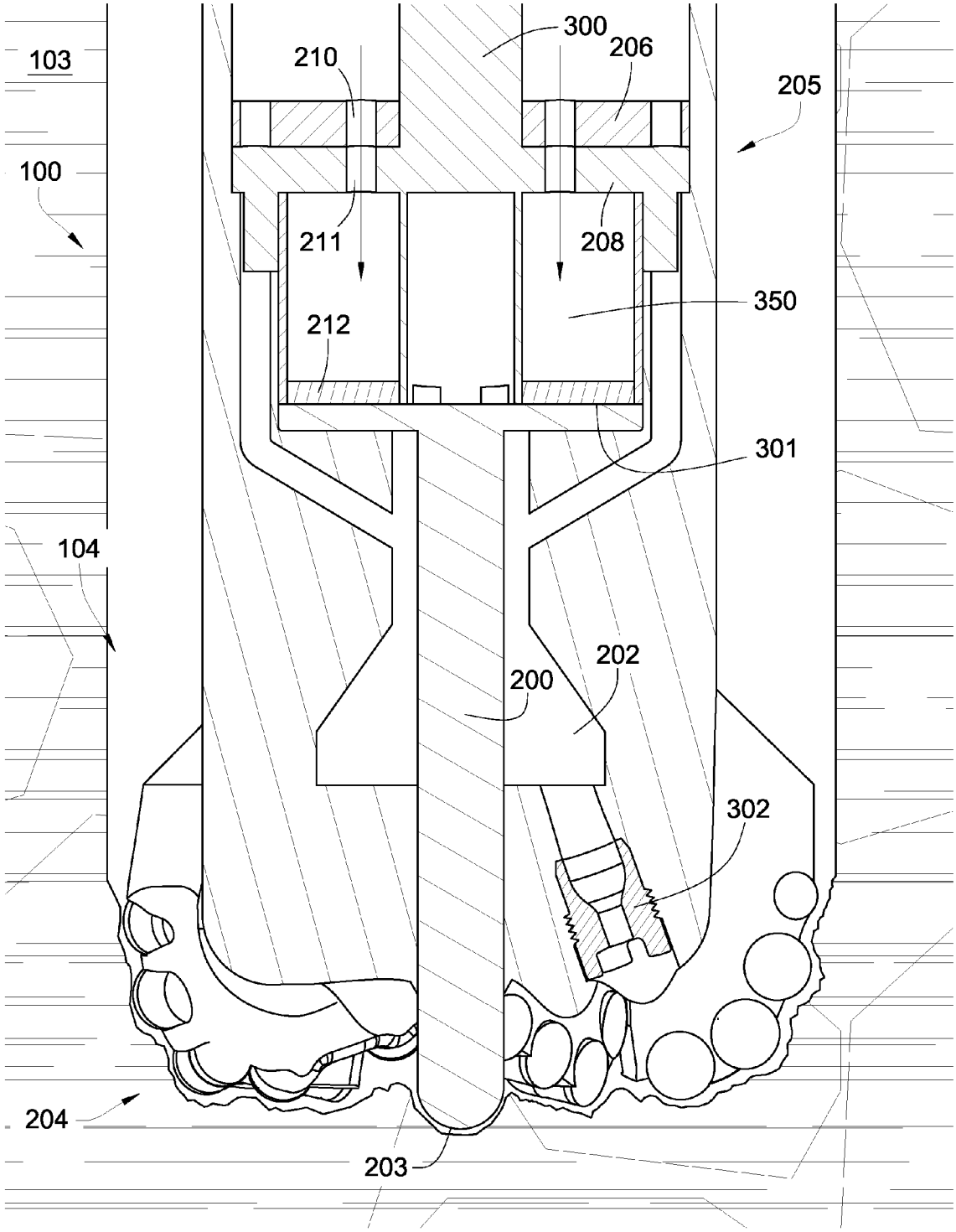
FIG. 3 is a cross-sectional diagram of another embodiment of a bottom-hole assembly.

FIGS. 3-6 are cross-sectional diagrams of several embodiments of a bottom-hole assembly 103 comprising a drill bit 104. In the preferred embodiment, a jack element 200 may be housed within a bore 202 of a tool string 100. A distal end 203 of the jack element 200 may extend beyond a working face 204 of the tool string 100. A rotary valve 205 disposed within the bore 202 may have a first disc 206 and a second disc 208, the first disc 206 being attached to a driving mechanism. In the embodiment of FIGS. 3-6 the first disc 206 is the top disc and the second disc is located beneath the first; however, the arrangement may be reversed. A shaft 300 may connect the driving mechanism to the valve 205. In some embodiments, the driving mechanism may be adapted to rotate the first disc 206 or the second disc 208. In other embodiments the jack element 200 may be adapted to rotate the first disc 206 or the second disc 208. During a drilling operation the driving mechanism and the jack element 200 may rotate opposite each other. As the discs 206, 208 rotate relative to one another at least one port 210 formed in the first disc 206 aligns with another port 211 formed in the second disc 208, wherein drilling fluid passes through the ports 210, 211 and may displace an element 212 in mechanical communication with the jack element 200. In these embodiments, the element 212 is a ring. In FIG. 3 drilling fluid may be passed through the valve 205 such that the element 212 is forced against a proximal end 301 of the jack element 200 causing the jack element to vibrate. These vibrations may be transferred into the formation 105. The jack element 200 may be displaced by the element 212 by the impact of the element. The first disc 206 and the second disc 208 may have other fluid ports that do not align with each other when the fluid ports 210, 211 are aligned. All of the drilling fluid or a portion of the drilling fluid may pass through the valve 205. The drill bit 104 may contain at least one nozzle 302 disposed within the bore 202 to control and direct the drilling fluid that may exit the working face 204 of the drill bit 104. All the fluid that may pass through the valve 205 may be directed to the bore 202 and through at least one nozzle 302.

Figure 4:
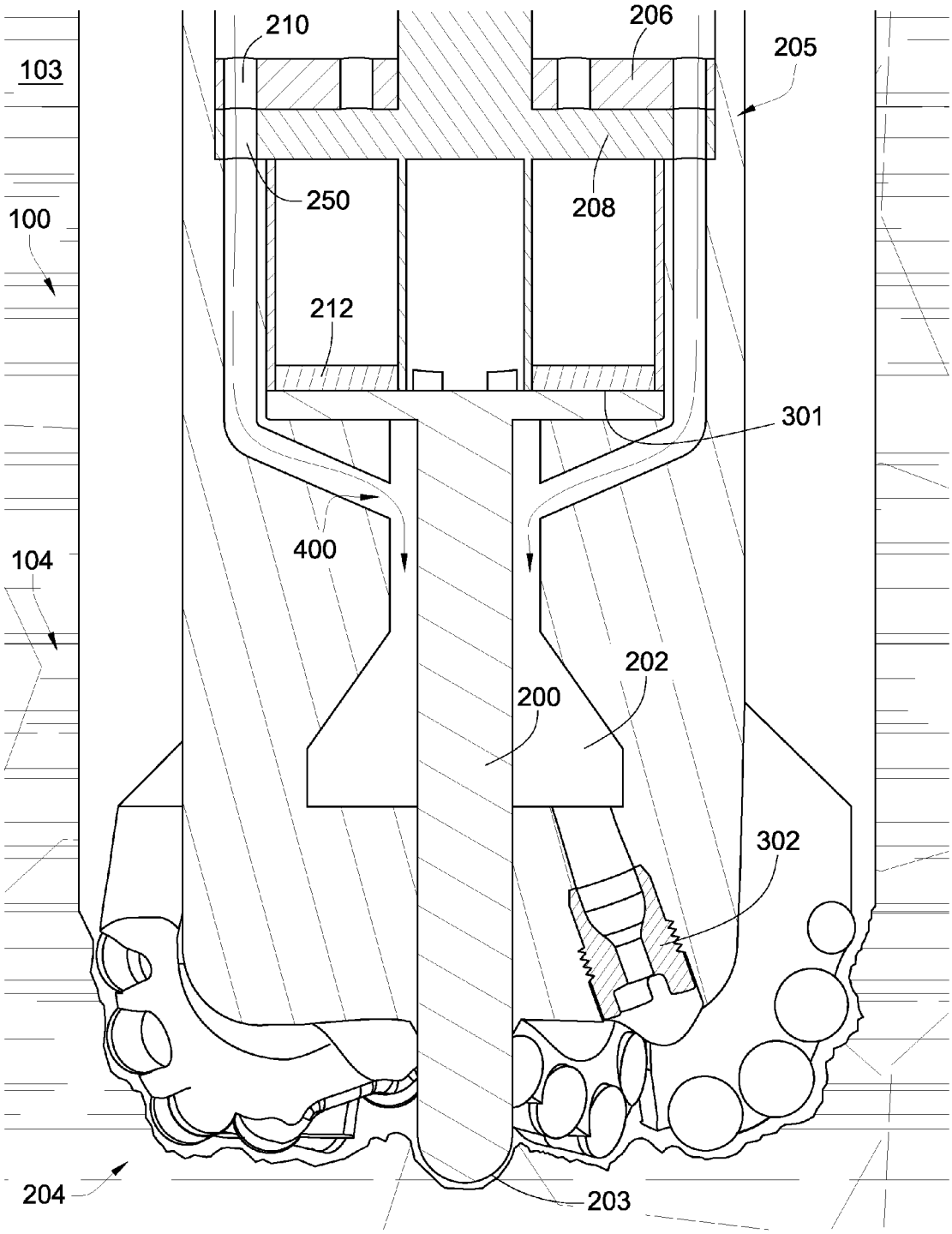
FIG. 4 is a cross-sectional diagram of another embodiment of a bottom-hole assembly.

In FIG. 4 the fluid ports 210, 250 are aligned such that drilling fluid bypasses the hydraulic chamber where the element 212 is disposed. During an operation as fluid passes through the valve 205, fluid directly flows into a bore 202 of the tool string 100 through openings 400 in the bore 202.

Figure 5:
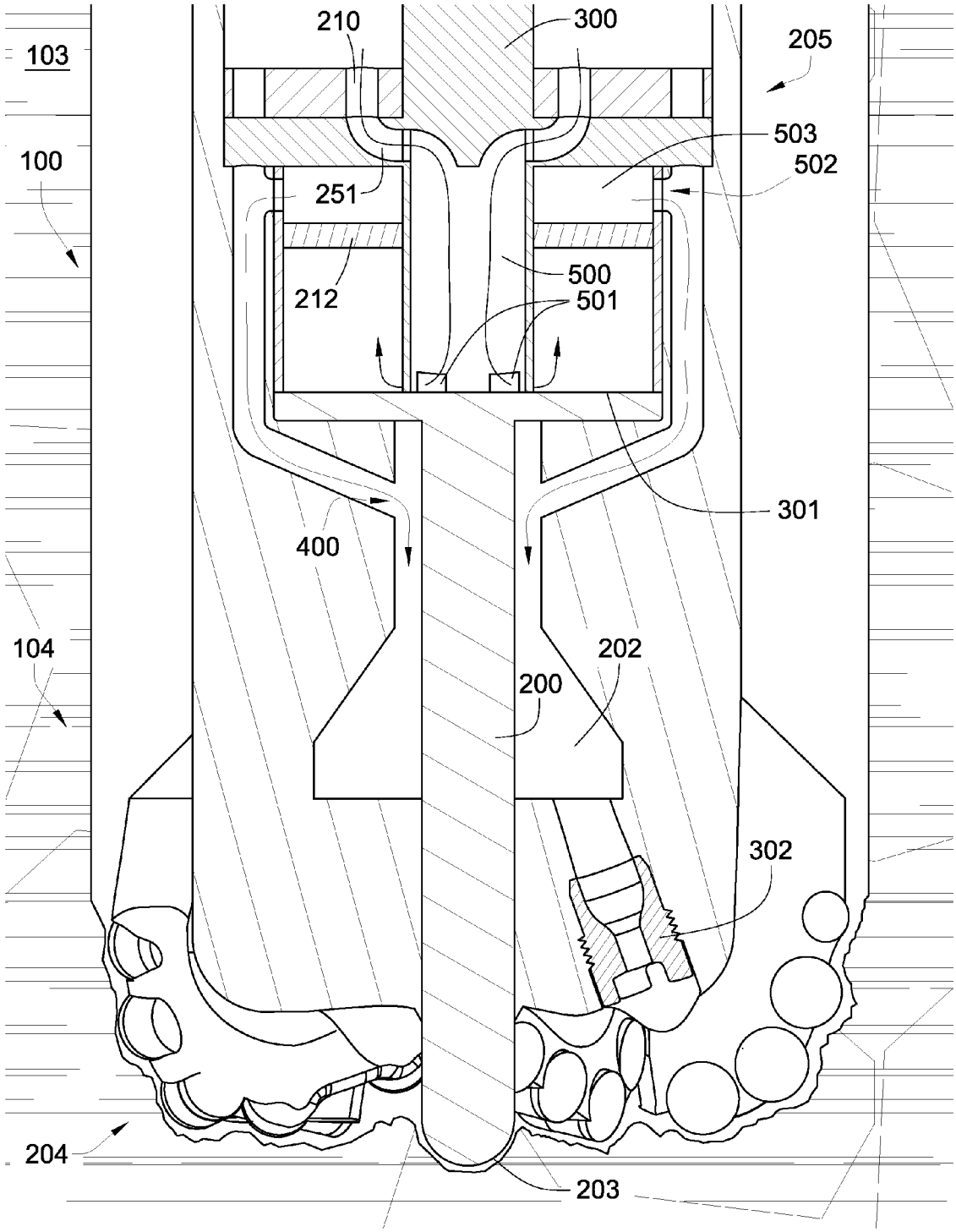
FIG. 5 is a cross-sectional diagram of another embodiment of a bottom-hole assembly.
Figure 6:
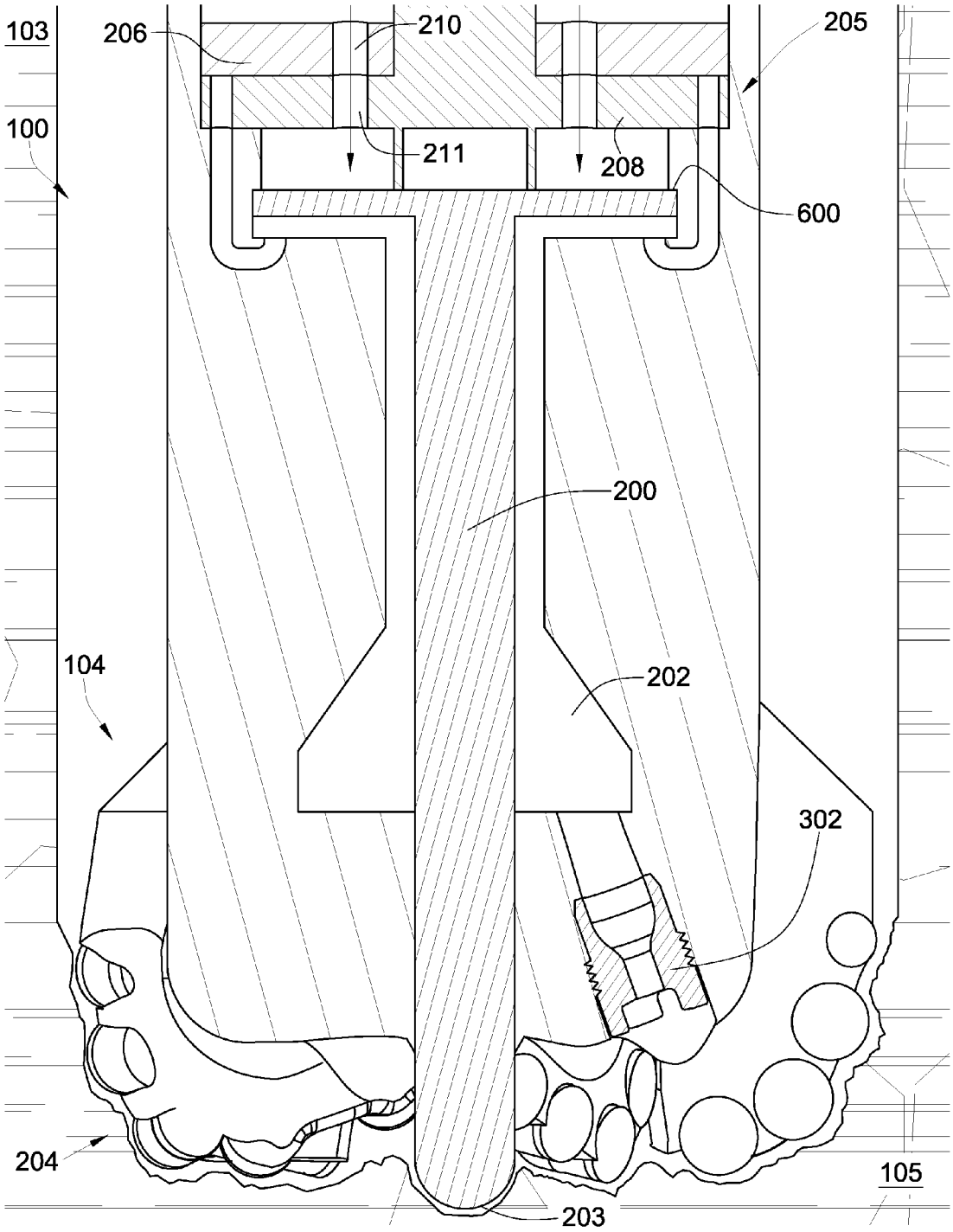
FIG. 6 is a cross-sectional diagram of another embodiment of a bottom-hole assembly.

In FIG. 5 the fluid ports 210, 251 align so that fluid may pass through the valve 205 into a cavity 500 formed within a shaft 300 to the driving mechanism The fluid port 251 formed in the second disc 208 may direct the fluid to the cavity 500. The fluid may flow from the cavity 500 through openings 501 and may force the element 212 away from the proximal end 301 of the jack element 200. The element 212 may force fluid through at least one opening 502 in a chamber 503, wherein the fluid may be directed through at least one other opening 400 disposed within the bore 202. The drilling fluid may then be directed through at least one nozzle 302.

In some embodiments, the element 212 may be rigidly attached to the jack element 200. More specifically, in FIG. 6, the element is part of the jack element 200 such that the drilling fluid is adapted to directly displace the jack element 200. The valve 205 may allow fluid to pass through the ports 210, 211 and force a distal end 203 of the jack element 200 into a formation 105. During operation, other fluid ports disposed within the first and second discs 206, 208 of the valve 205 may align, causing fluid to displace the jack element 200 away from the formation 105. A stop 600 may limit the displacement of the jack element 200. In this embodiment, the drilling fluid may cause the jack element 200 to oscillate and better penetrate the formation 105.

Figure 8:
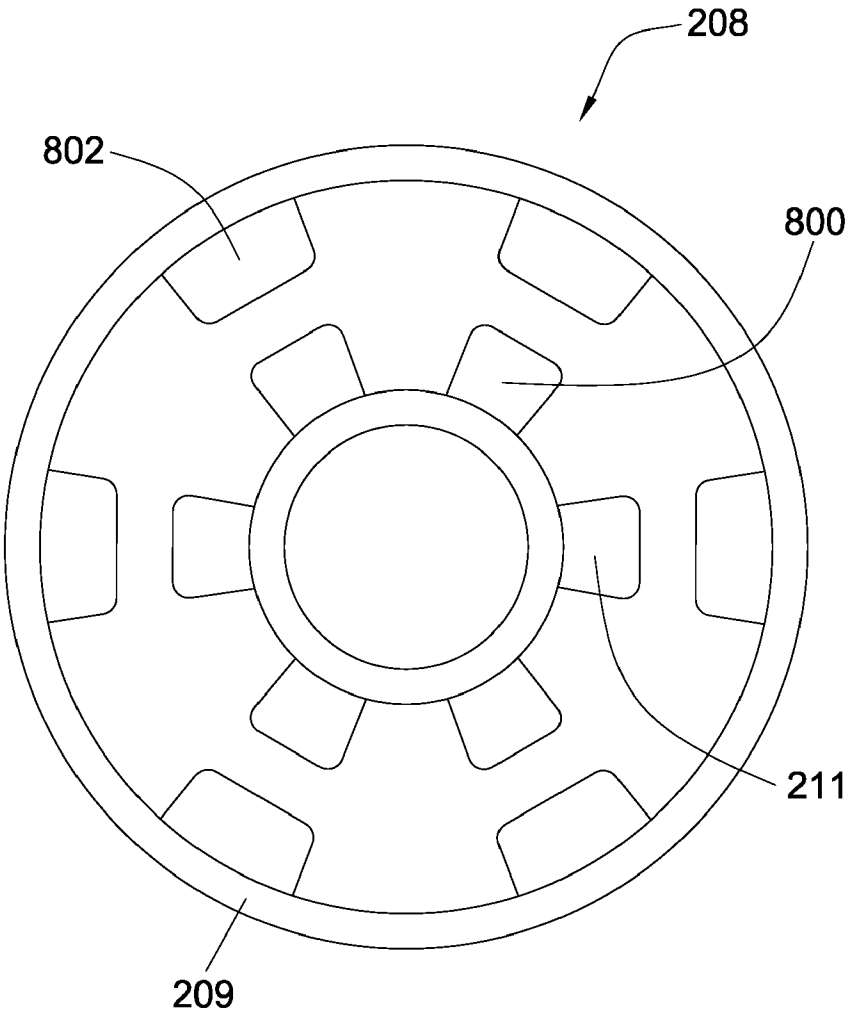
FIG. 8 is a sectional diagram of another embodiment of a valve in a downhole tool string component.
Figure 7:
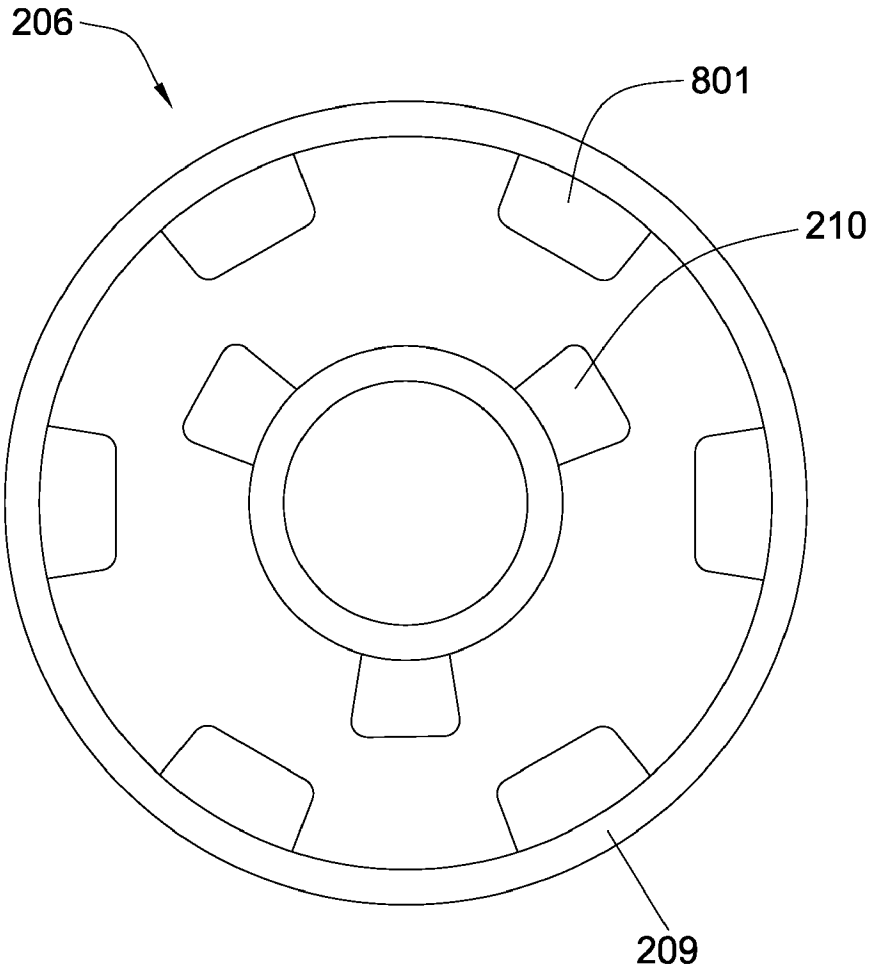
FIG. 7 is a sectional diagram of an embodiment of a valve in a downhole tool string component.

FIGS. 7 and 8 are sectional diagrams of an embodiment of a first disc 206 and a second disc 208 of a valve in a downhole tool string component. The discs 206, 208 may be axially aligned and may contact each other along a flat surface 209. The flat surface 209 of the disc may comprise a material selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bounded diamond, and/or combinations thereof. The first disc 206 or the second disc 208 may be attached to a driving mechanism. A jack element may be adapted to rotate the first disc 206 or the second disc 208. At least one port 210 may be formed in the first disc 206 and at least two ports 211, 800 may be formed in the second disc 208. During operation, the discs 206, 208 may rotate relative to each other such that fluid passes through the ports 210, 211 and displace an element in mechanical communication with the jack element.

In the preferred embodiment, the port 210 of the first disc 206 may align with the two ports 211, 800 while rotating. As fluid passes through the different ports 211, 800 the fluid may displace the element away from the valve or toward the valve, as shown in FIGS. 3 and 5. The first disc 206 may have a plurality of fluid ports 801 around the periphery of the disc. The second disc 208 may also have a plurality of fluid ports 802 around the periphery of the disc. As the two discs 206, 208 rotate relative to each other; the fluid ports 801, 802 may align such that drilling fluid bypasses the element as shown in FIG. 4. In some embodiments all the drilling fluid may pass through the fluid ports, whereas in other embodiments, only a portion of the drilling fluid passes through the fluid ports.

Figure 9:
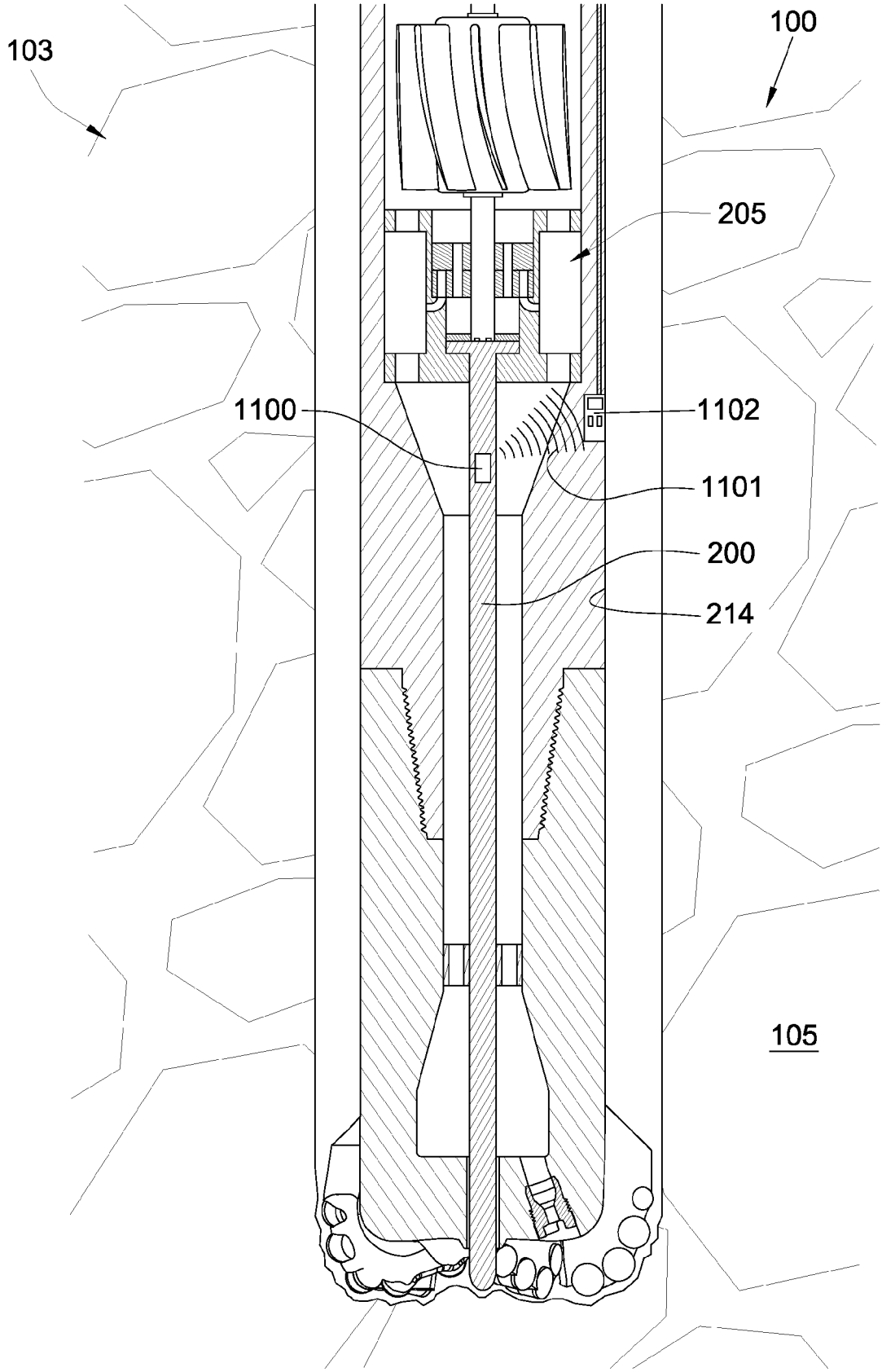
FIG. 9 is a cross-sectional diagram of another embodiment of a bottom-hole assembly.

FIG. 9 is a cross-sectional diagram of an embodiment of a bottom-hole assembly 103 comprising a rotary valve 205. In the preferred embodiment a sensor 1100 may be attached to a jack element 200. The sensor 1100 may be a geophone, a hydrophone or another seismic sensor. The sensor 1100 may receive acoustic reflections 1101 produced by the movement of a jack element 200 as it oscillates or vibrates. Electrical circuitry 1102 may be disposed within a bore wall 214 of a tool string 100. The electrical circuitry 1102 may sense acoustic reflections 1101 from the sensor 1100. The electrical circuitry 1102 may be adapted to measure and maintain the orientation of the tool string 100 with respect to a subterranean formation 105 being drilled.

Figure 10:
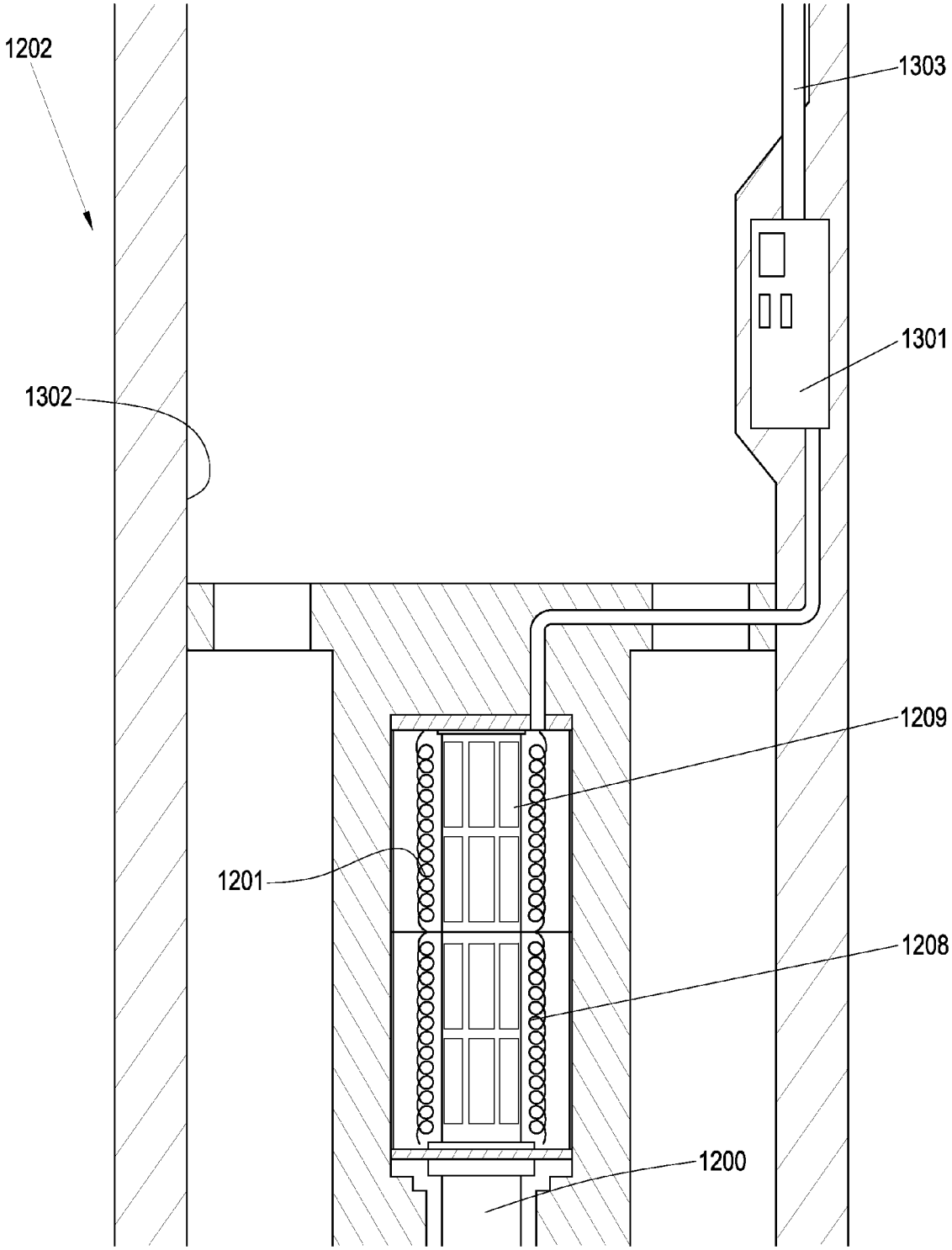
FIG. 10 is a cross-sectional diagram of a driving mechanism.

Referring to FIG. 10, the driving mechanism may be an electric generator 1208. One such generator 1208 which may be used is the Astro 40 from AstroFlight, Inc. The generator 1208 may comprise separate magnetic strips 1209 disposed along the outside of the rotor 1200 which magnetically interact with the coil 1201 as it rotates, producing a current in the electrically conductive coil. The magnetic strips are preferably made of samarium cobalt due to its high curie temperature and high resistance to demagnetization.

The coil is in communication with a load. When the load is applied, power is drawn from the generator 1208, causing the turbine to slow its rotation, which thereby slows the rotation discs with respect to one another and thereby reduces the frequency the element may move in and out of contact with the jack element. Thus the load may be applied to control the vibrations of the jack element. The load may be a resistor, nichrome wires, coiled wires, electronics, or combinations thereof. The load may be applied and disconnected at a rate at least as fast as the rotational speed of driving mechanism. There may be any number of generators used in combination. In embodiments where the driving mechanism is a valve or a hydraulic motor, a valve may control the amount of fluid that reaches the driving mechanism, which may also control the speed at which they rotate.

The electrical generator may be in communication with the load through electrical circuitry 1301. The electrical circuitry 1301 may be disposed within the bore wall 1302 of the component 1202. The generator may be connected to the electrical circuitry 1301 through a coaxial cable. The circuitry may be part of a closed-loop system. The electrical circuitry 1301 may also comprise sensors for monitoring various aspects of the drilling, such as the rotational speed or orientation of the component with respect to the formation. Sensors may also measure the orientation of the generator with respect to the component.

The data collected from these sensors may be used to adjust the rotational speed of the turbine in order to control the jack element.

The load may be in communication with a downhole telemetry system 1303. One such system is the IntelliServ system disclosed in U.S. Pat. No. 6,670,880, which is herein incorporated by reference for all that it discloses. Data collected from sensors or other electrical components downhole may be sent to the surface through the telemetry system 1303. The data may be analyzed at the surface in order to monitor conditions downhole. Operators at the surface may use the data to alter drilling speed if the jack element encounters formations of varying hardness. Other types of telemetry systems may include mud pulse systems, electromagnetic wave systems, inductive systems, fiber optic systems, direct connect systems, wired pipe systems, or any combinations thereof. In some embodiments, the sensors may be part of a feed back loop which controls the logic controlling the load. In such embodiments, the drilling may be automated and electrical equipment may comprise sufficient intelligence to avoid potentially harsh drilling formations while keeping the drill string on the right trajectory.

Whereas the present invention has been described in particular relation to the drawings attached hereto, it should be understood that other and further modifications apart from those shown or suggested herein, may be made within the scope and spirit of the present invention.

What is claimed is:

1. A tool string, comprising:

a jack element substantially coaxial with an axis of rotation housed within a bore of the tool string, the jack element comprises a distal end extending beyond a working face of the tool string;

a rotary valve disposed within the bore of the tool string comprising a first disc attached to a driving mechanism and a second disc axially aligned with and contacting the first disc along a flat surface;

wherein as the discs rotate relative to one another at least one port formed in the first disc aligns with another port in the second disc;

wherein fluid passed through the ports is adapted to displace an element in mechanical communication with the jack element.

2. The tool string of claim 1, wherein the driving mechanism is a turbine, generator, or a motor.

3. The tool string of claim 1, wherein the jack element is adapted to rotate the second disc.

4. The tool string of claim 1, wherein the second disc is fixed to a bore wall of the tool string.

5. The tool string of claim 1, wherein the jack element and the driving mechanism rotate opposite each other.

6. The tool string of claim 1, wherein the jack element is stationary with respect to a formation.

7. The tool string of claim 1, wherein at least two fluid ports are formed in the second disc.

8. The tool string of claim 1, wherein all the drilling fluid is passed through the fluid ports.

9. The tool string of claim 1, wherein a portion of the drilling fluid is passed through the fluid ports.

10. The tool string of claim 1, wherein a sensor attached to the tool string is adapted to receive acoustic signals produced by the movement of the jack element.

11. The tool string of claim 1, wherein the element is a ring, a rod, a piston, or a block.

12. The tool string of claim 1, wherein the element is rigidly attached to the jack element.

13. The tool string of claim 1, wherein the element is part of the jack element.

14. The tool string of claim 1, wherein the flat surface comprise a material selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bounded diamond, and/or combinations thereof.

15. The tool of claim 1, wherein the rotary valve is disposed within the drill bit.

16. The tool of claim 1, wherein driving mechanism operates at different speeds.

17. The tool of claim 1, wherein the rotary valve is in communication with a telemetry system.

18. The tool of claim 1, wherein the speed of the driving mechanism is controlled by a closed loop system.

19. The tool of claim 1, wherein a rotor connects the first disc to the driving mechanism.

20. The tool of claim 19, wherein a hydraulic cavity in formed in the rotor.

* * * * *